US005699559A

United States Patent [19]

Sano

[11] Patent Number: 5,699,559

[45] Date of Patent: Dec. 23, 1997

[54] BODYSUIT HAVING FREELY MOVEABLE STRAPS

[76] Inventor: Michiko Sano, 209, Futai-cho, Marugame-shi, Kagawa-ken, Japan

[21] Appl. No.: 514,556

[22] Filed: Aug. 14, 1995

[51] Int. Cl.[6] ..... A41D 7/00; A41B 9/00

[52] U.S. Cl. ..... 2/67; 2/78.3; 450/115; 450/122; 450/131

[58] Field of Search ..... 2/67, 69, 78.3; 450/115, 116, 109, 122, 123, 129, 130, 131, 132, 137, 151

[56] References Cited

U.S. PATENT DOCUMENTS

| | | | |
|---|---|---|---|
| Re. 21,595 | 10/1940 | Imershein | 450/151 |
| 2,069,014 | 1/1937 | Molyneux-Seel | 450/123 X |
| 2,168,009 | 8/1939 | Van Praag | 450/131 X |
| 2,205,745 | 6/1940 | Fridolph | 450/99 |
| 2,344,674 | 3/1944 | Brown . | |
| 2,962,026 | 11/1960 | Hanken | 450/99 |
| 3,194,242 | 7/1965 | Marchisella | 450/109 |
| 3,774,621 | 11/1973 | Dabe | 450/115 |
| 4,698,847 | 10/1987 | Yoshihara | 2/67 X |
| 4,815,145 | 3/1989 | Chow | 2/67 |
| 5,045,019 | 9/1991 | Capasso et al. | 450/59 X |

FOREIGN PATENT DOCUMENTS

| | | |
|---|---|---|
| 4-21764 | 5/1992 | Japan . |
| 7-3505 | 1/1995 | Japan . |

*Primary Examiner*—C. D. Crowder
*Assistant Examiner*—Shirra L. Jenkins
*Attorney, Agent, or Firm*—Graham & James LLP

[57] ABSTRACT

A shapesuit comprises a body formed by sewing together a front body and a back body; and at least a pair of stretchable straps extended diagonally and substantially in an X-shape on and sewn to either the front body or the back body so that the middle portions thereof intersect each other. When the front body is provided with the stretchable straps in an X-shaped arrangement, the stretchable straps lift superfluous flesh on the waist toward the middle of the wearer's body, and flattens the stomach and the waist by their elasticities. When the back body is provided with the stretchable straps in an X-shaped arrangement, the stretchable back straps lift superfluous flesh on opposite sides of the buttocks toward the middle of the wearer's body so that the width across the hips is reduced and the middle between the hips bulges out backward, pull the shoulders backward so that the spine is straightened to correct the posture. Thus, the shapesuit shapes up the body form.

16 Claims, 5 Drawing Sheets

BODYSUIT HAVING FREELY MOVEABLE STRAPS

BACKGROUND OF THE INVENTION

1. Field of the Invention

The present invention relates to a shapesuit for shaping up the body form.

2. Description of the Related Art

Some conventional shapesuits are formed entirely of a stretchable fabric or a stretchable net fabric, and some other conventional shapesuits are formed partly of an unstretchable fabric or an unstretchable net fabric. A shapesuit formed entirely of a stretchable fabric or a stretchable net fabric merely firms the wearer's body evenly and scarcely has effect in shaping up the body form. A shapesuit formed partly of an unstretchable fabric or an unstretchable net fabric fits only the wearer's body of an intended body form and, when put on the body of a person having an unintended body form, worsens the body form instead of improving the same. Therefore, the latter shapesuit fits only bodies of limited body forms.

SUMMARY OF THE INVENTION

The present invention has been made in view of those problems in the conventional shapesuits and it is therefore an object of the present invention to provide a shapesuit capable of highly effectively shaping up body form, and effectively and satisfactorily fitting bodies of a large variety of body forms.

With the foregoing object in view, the present invention provides a shapesuit provided with at least a pair of stretchable straps extended diagonally and substantially in an X-shape so that the middle portions thereof intersect each other on and sewn to either the front body or the back body, or each of the front body and the back body.

The shapesuit in accordance with the present invention is characterized by:

- the front body and the back body formed of a material formed of stretchable fibers less stretchable than the stretchable straps,
- the stretchable front and the stretchable back straps having a tapering width increasing from the upper end toward the lower end,
- sewing the upper end of each stretchable strap to a portion of the body corresponding to the armpit or a portion slightly below the portion corresponding to the armpit,
- sewing the lower end of each stretchable strap to the edge of a leg opening,
- sewing only the upper and the lower end of each stretchable strap to the body so that the portion between the upper and the lower end of the stretchable strap remains unfixed,
- sewing the stretchable front and the stretchable back straps entirely to the body,
- longitudinally extending unstretchable side straps along the seam lines between the front and the back body, and sewing the respective upper ends and the lower ends of the stretchable front and the stretchable back straps to the unstretchable side straps, and
- stretchable buttock supporting straps each extended from the lower end of each of the stretchable back straps arranged substantially in an X-shape toward the crotch and sewn to the edge of each leg opening.

The stretchable front straps arranged substantially in an X-shape on and sewn to the front body lift superfluous flesh on the waist toward the middle of the wearer's body, and flattens the stomach and the waist by their elasticities. The stretchable back straps arranged substantially in an X-shape on and sewn to the back body lift superfluous flesh on the buttocks toward the middle of the wearer's body so that the width across the hips is reduced and the middle between the hips bulges out backward, pull the shoulders backward so that the spine is straightened to correct the posture. Thus, the shapesuit of the present invention shapes up the body form.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
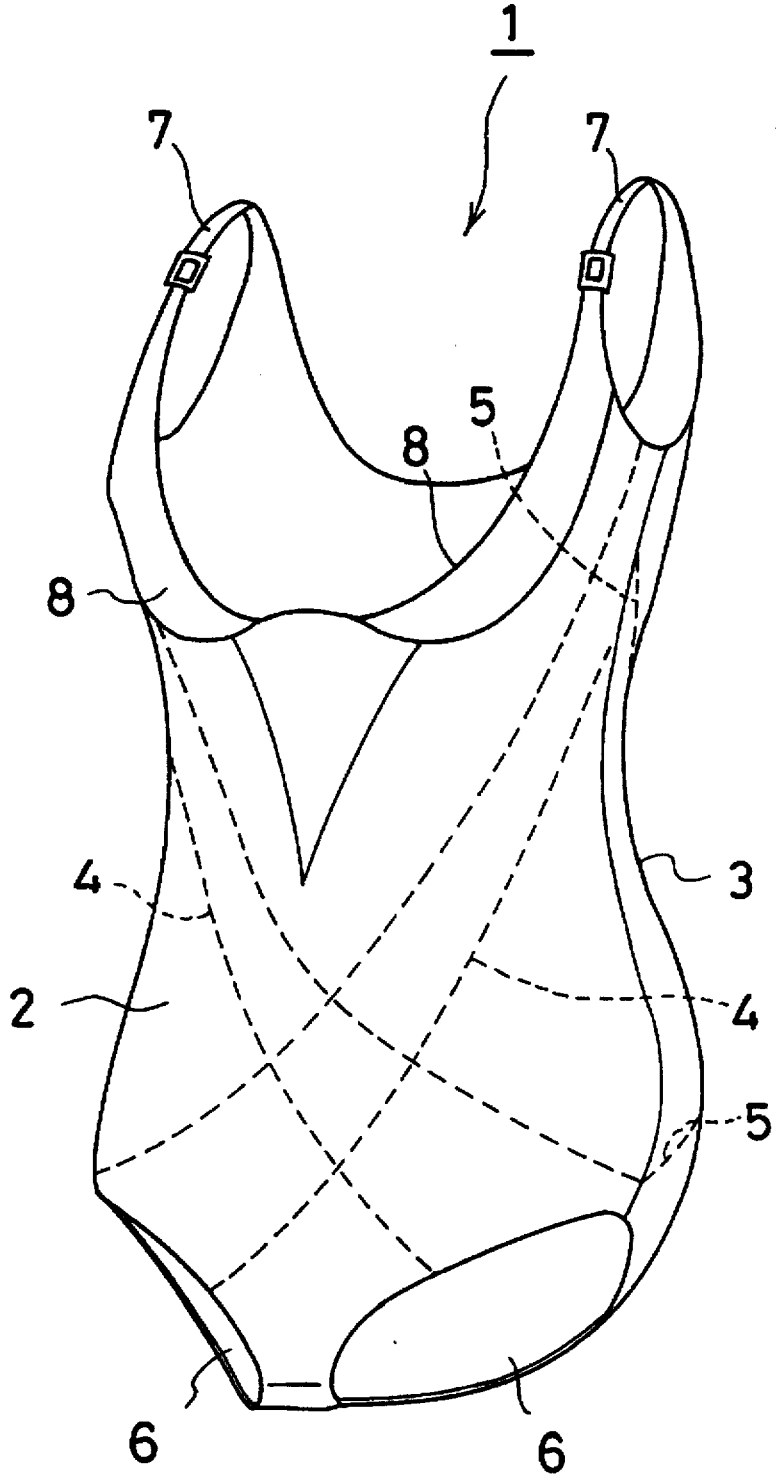
FIG. 1 is a perspective front view of a shapesuit in a first embodiment according to the present invention.
Figure 2:
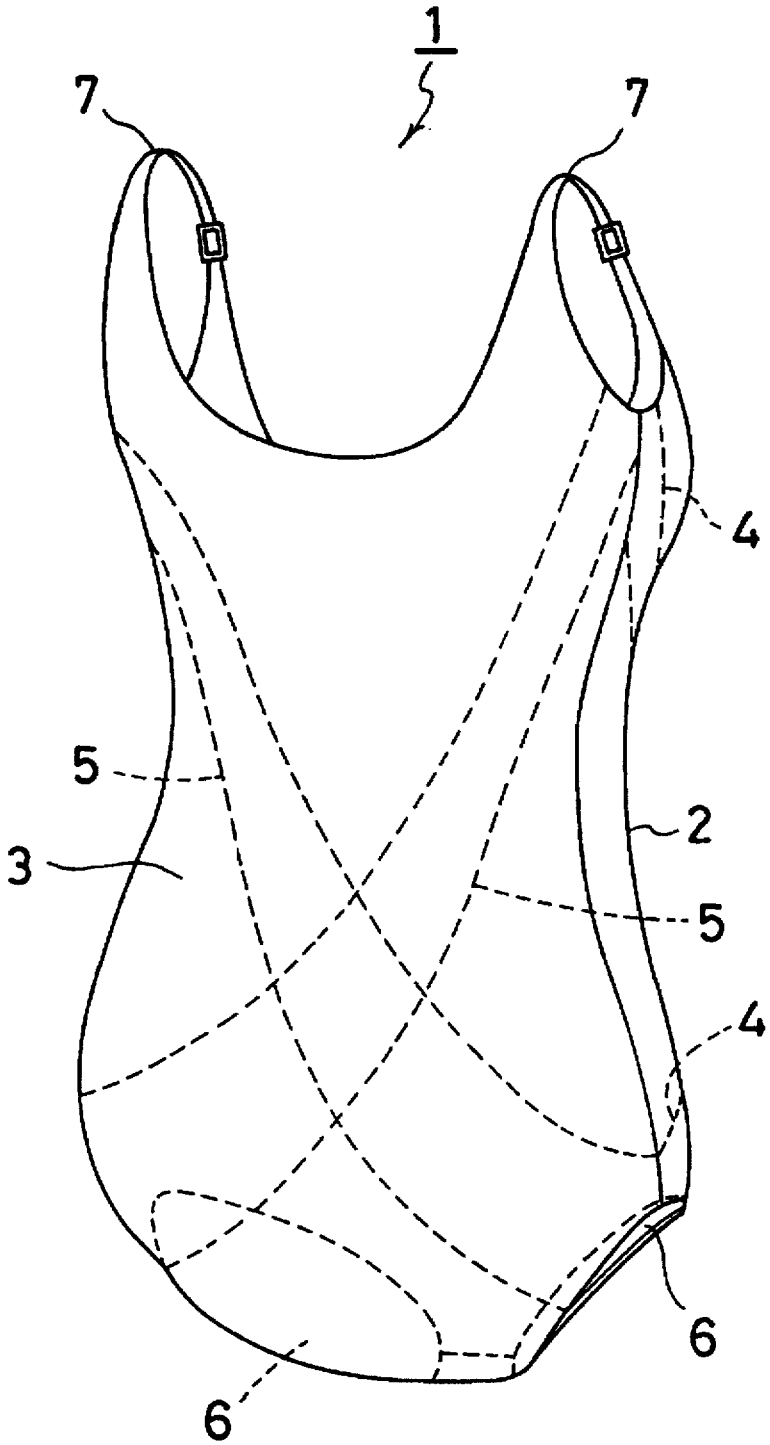
FIG. 2 is a perspective back view of the shapesuit of FIG. 1.

First Embodiment (FIGS. 1 and 2)

Referring to FIGS. 1 and 2, a shapesuit 1 has a front body 2 and a back body 3. A pair of stretchable front straps 4 are extended diagonally and in an X-shape on the front body 2 so that the middle portions thereof intersect each other in the middle portion of the front body 2, and a pair of stretchable back straps 5 are extended diagonally and in an X-shape on the back body 3 so that the middle portions thereof intersect each other in the middle portion of the back body 3. The opposite ends of the pair of stretchable front straps 4 are sewn to the front body 2, and the opposite ends of the pair of stretchable back straps 5 are sewn to the back body 3. The front body 2 and the back body 3 are formed of a fabric or a net of stretchable fibers having an elasticity less than that of the stretchable straps 4 and 5. Each of the stretchable straps 4 and 5 has a tapered width gradually increasing toward the lower end.

The narrower upper ends of the stretchable front straps 4 attached to the front body 2 are sewn to the edges of the armholes, respectively, and the wider lower ends of the stretchable front straps 4 are sewn to the edges of the leg openings 6, respectively. The narrower upper ends of the stretchable back straps 5 attached to the back body 3 are sewn to the edges of the arm holes, respectively, and the wider lower ends of the stretchable back straps 5 are sewn to the edges of the leg openings 6, respectively. Since only the upper and the lower ends of the stretchable straps 4 and 5 are sewn to the front body 2 and the back body 3, the middle portions of the stretchable straps 4 and 5 near the intersection points are able to move freely in longitudinal directions relative to each other. The shapesuit 1 is provided with shoulder straps 7, and bust support cups 8 for covering only the underside of the breasts.

The stretchable front straps 4 arranged substantially in an X-shape on and sewn to the front body 2 lift superfluous flesh on the waist toward the middle of the wearer's body, and flattens the stomach and the waist by their elasticities.

The stretchable back straps 5 arranged substantially in an X-shape on and sewn to the back body 3 lift superfluous flesh on the buttocks toward the middle of the wearer's body so that the width across the hips is reduced and the middle between the hips bulges out backward, pull the shoulders backward so that the spine is straightened to correct the posture. Thus, the shapesuit 1 shapes up the body form.

Figure 3:
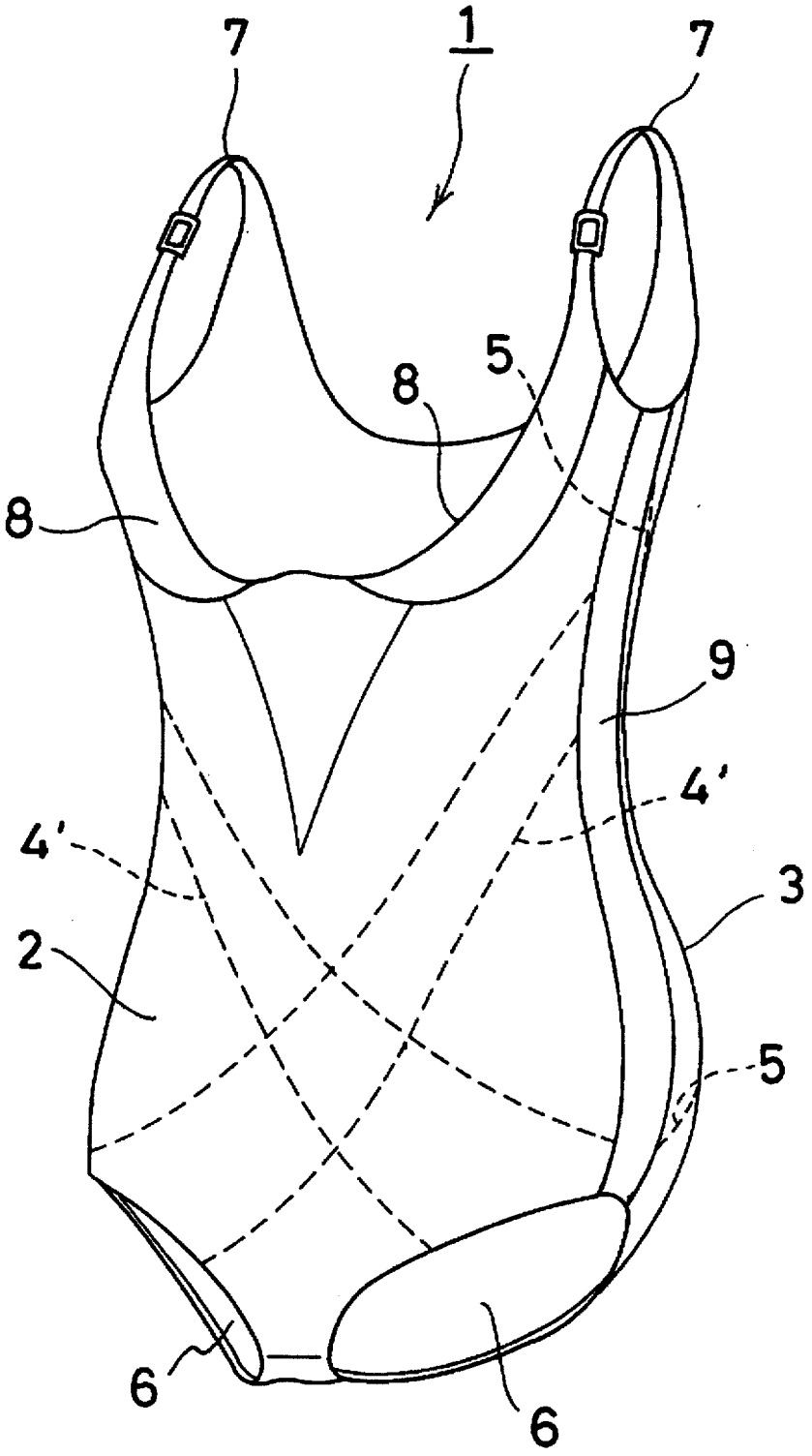
FIG. 3 is a perspective front view of a shapesuit in a second embodiment according to the present invention.

Second Embodiment (FIG. 3)

FIG. 3 shows a shapesuit in a second embodiment according to the present invention, in which parts like or corresponding to those of the shapesuit 1 in the first embodiment are designated by the same reference numerals and the description thereof will be omitted.

A shapesuit 1 in the second embodiment has a front body 2 and a back body 3. Side unstretchable straps 9 are extended longitudinally along the side seams between the front body 2 and the back body 3. The opposite ends of a pair of stretchable front straps 4' and a pair of stretchable back straps 5 are sewn to the unstretchable side straps 9, respectively. The upper ends of the stretchable front straps 4' are sewn to the unstretchable side straps 9 at positions slightly lower than the upper ends of the stretchable front straps 4 and the stretchable back straps 5 of the shapesuit 1 in the first embodiment.

The shapesuit 1 in the second embodiment has functions and effects to stabilize the supporting action of the stretchable straps 4' and 5, to make the figure look slimmer and to maintain shapely body contours, in addition to the functions and the effects of the shapesuit 1 in the first embodiment. Since the upper ends of the stretchable front straps 4' are sewn to the unstretchable side straps 9 at positions slightly below the armholes, the busts are not pressed to make the wearer feel comfortable. The unstretchable side straps 9 avoid the twisting and creasing of the body even if the longitudinal positions at which the stretchable front straps 4' and the stretchable back straps 5 are sewn to the unstretchable side straps 9 are changed.

Figure 4:
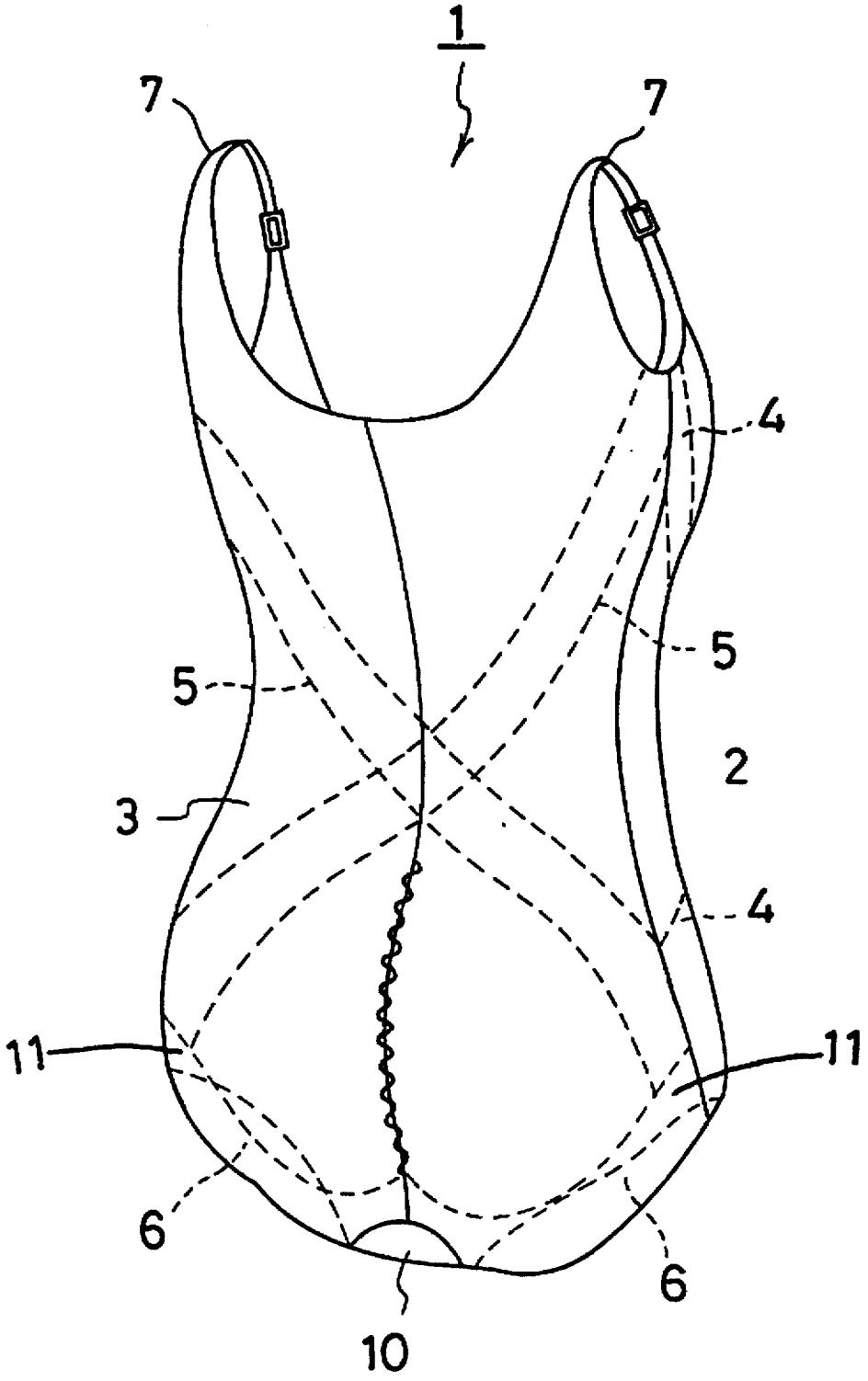
FIG. 4 is a perspective back view of a shapesuit in a third embodiment according to the present invention.

Third Embodiment (FIG. 4)

FIG. 4 shows a shapesuit 1 in a fourth embodiment according to the present invention, in which parts like or corresponding to those of the shapesuit 1 in the first embodiment are designated by the same reference numerals and the description thereof will be omitted. Referring to FIG. 4, the shapesuit 1 in the third embodiment is substantially the same in construction as the shapesuit 1 in the first embodiment, except that the shapesuit 1 in the third embodiment is provided with stretchable buttock supporting straps 11. The stretchable buttock supporting straps 11 are extended from the lower ends of a pair of stretchable back straps 5 arranged in an X-shape on a back body 3 along the edges of leg openings 6 toward a crotch 10 and sewn to the edges of the leg openings 6, respectively. The stretchable buttock supporting straps 11 may be formed of the same material as that forming stretchable front straps 4 arranged in an X-shape on a front body 2 and the stretchable back straps 5.

The stretchable buttock supporting straps 11 support the buttocks so that the buttocks look shapely. The lower ends of the stretchable back straps 5 and the stretchable buttock supporting straps 11 surround the buttocks substantially in a circular shape so that the buttocks bulge backward and are supported in a shapely form.

Figure 5:
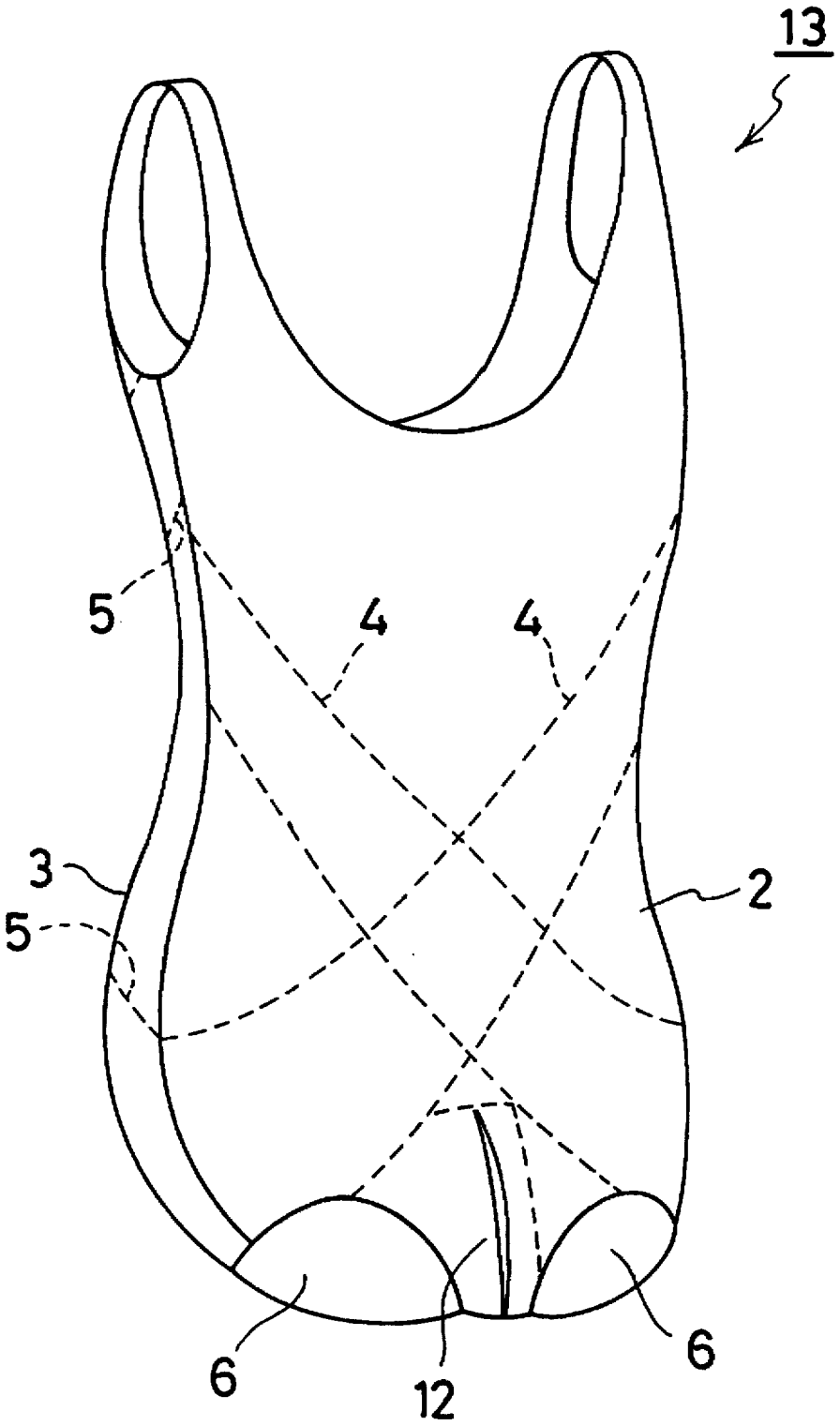
FIG. 5 is a perspective front view of a shapesuit in a fourth embodiment according to the present invention.

Fourth Embodiment (FIG. 5)

A shapesuit 13 in a fourth embodiment according to the present invention is substantially the same in construction as the shapesuit 1 in the first embodiment, except that the shapesuit 13 in the fourth embodiment is provided with a gore 12 in a portion of a front body 2 corresponding to the crotch and is intended for use by men.

Although only the opposite ends of the pair of stretchable front straps 4 arranged in an X-shape on the front body 2, the pair of stretchable front straps 4' arranged in an X-shape on the front body 2, and the pair of stretchable back straps 5 in the foregoing embodiments are sewn to the front body 2 and the back body 3, respectively, the stretchable front straps 4 and 4' and the stretchable back straps 5 may be entirely sewn to the front body 2 and the back body 3, respectively.

Only either the front body 2 or the back body 3 may be provided with a pair of stretchable straps in an X-shape, a pair of stretchable straps may be arranged in an X-shape only on the outer surface of the front body 2, a pair of stretchable straps may be arranged in an X-shape only on the outer surface of the back body 3, or a pair of stretchable straps may be arranged in an X-shape only on the inner surface of the front body 2 or the back body 3.

When only the front body 2 is provided with the stretchable front straps 4 or 4' in an X-shaped arrangement, the stretchable front straps 4 or 4' lift superfluous flesh on the waist toward the middle of the wearer's body, and flattens the stomach and the waist by their elasticities. When only the back body 3 is provided with the stretchable back straps 5 in an X-shaped arrangement, the stretchable back straps 5 lift superfluous flesh on opposite sides of the buttocks toward the middle of the wearer's body so that the width across the hips is reduced and the middle between the hips bulges out backward, pull the shoulders backward so that the spine is straightened to correct the posture. Thus, the shapesuit 1 shapes up the body form.

Thus, the present invention has the following effects.

(a) When only the front body is provided with the stretchable front straps in an X-shaped arrangement, the stretchable front straps lift superfluous flesh on the waist toward the middle of the wearer's body, and flattens the stomach and the waist by their elasticities. When only the back body is provided with the stretchable back straps in an X-shaped arrangement, the stretchable back straps lift superfluous flesh on opposite sides of the buttocks toward the middle of the wearer's body so that the width across the hips is reduced and the middle between the hips bulges out backward, pull the shoulders backward so that the spine is straightened to correct the posture. Thus, the shapesuit 1 shapes up the body form.

(b) When the front body is provided with the pair of stretchable front straps in an X-shaped arrangement and the back body is provided with the pair of stretchable back straps in an X-shaped arrangement, the present invention provides an effect that the function of the stretchable front straps to tighten the waist forward and upward and the function of the stretchable back straps to pull the shoulders backward cooperate in enhancing the spine straightening effect of the shapesuit in addition to the aforesaid effects.

(c) The bold X-shaped arrangement of stretchable front straps on the front body or the bold X-shaped arrangement of the stretchable back straps on the back body enables the shapesuit enables the shapesuit to fit a large variety of figure types, enables the shapesuit to fit body forms in a body form range far wider than a body form range including body forms to which conventional shapesuits locally incorporating various elaborate contrivances are applicable, and provides an enhanced body form correcting effect.

(d) The front body and the back body formed of a material of stretchable fibers having an elasticity less than that of the stretchable straps enable the shapesuit to fit widely different body forms effectively, further widen the body form range including body forms to which the shapesuit is applicable, and corrects those body forms satisfactorily and effectively.

(e) The stretchable front straps and the stretchable back straps each having a tapered width increasing toward the lower end are greatly effective in lifting up superfluous flesh in the lower parts of the wearer's body.

(f) When the upper ends of the stretchable straps are sewn to the edges of the arm holes or to portions of the body slightly below the edges of the arm holes, superfluous flesh on the armpits can be pushed toward the front so that the busts look large, the cups do not press the busts and support the busts satisfactorily. Particularly, when a woman wearing a brassiere puts on the shapesuit, the stretchable front straps extended in an X-shape on the front body push the cups of the brassiere and the busts toward the front to make the breast look shapely and reduce the pressure of the brassiere on the busts.

(g) When the lower ends of the stretchable straps are sewn to the edges of the leg openings, the lower ends of the stretchable straps are held in place stably, the effect of the stretchable front straps in lifting up superfluous flesh on the stomach is enhanced, and the effect of the stretchable back straps in lifting up superfluous flesh on the buttocks is enhanced.

(h) When only the opposite ends of the stretchable front straps and the stretchable back straps are sewn to the body to leave the middle portions between the opposite ends of the same free to move, the stretchable front and the stretchable back straps are able to be stretched freely. Consequently, the shapesuit secures mobility for the wearer and by wearer's body can be twisted and bent sideways without resistance.

(i) When the stretchable front and the stretchable back straps are sewn entirely to the body, the stretchable front and the stretchable back straps are not caught by the wearer's arms and legs when putting the shapesuit on and off the wearer, and the wearer is able to put on the shapesuit fitly.

(j) When the unstretchable side straps are extended longitudinally along the seams between the front and the back body, and the opposite ends of the stretchable straps are sewn to the unstretchable side straps, the stretchable straps can be held stably, the longitudinal positions of the opposite ends of the stretchable front and the stretchable back straps can be changed without entailing any trouble, the shapesuit is able to support the wearer's body in a slim front silhouette and to maintain shapely side contours.

(k) The stretchable buttock supporting straps each extended from the lower end of each of the stretchable back straps arranged in an X-shape along the edge of the leg opening toward the crotch and sewn to the edge of the leg opening support the buttocks in a shapely form and surround the buttocks substantially in a circular shape so that the buttocks bulge backward and are supported in a shapely form.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A shapesuit comprising:

a body formed by sewing together a front body and a back body; and at least a pair of stretchable straps extended diagonally and substantially in an X-shape along the front body so that the middle portions thereof intersect each other, and the ends of the stretchable straps are sewn to the body, wherein the middle portions of the stretchable straps move freely with respect to each other, and wherein unstretchable side straps are extended longitudinally along the seams between the front body and the back body, and the opposite ends of the stretchable straps are sewn to the unstretchable side straps.

2. A shapesuit according to claim 1, wherein the front and the back body are formed of a material of stretchable fibers having an elasticity less than that of the stretchable straps.

3. A shapesuit according to claim 1, wherein each of the stretchable straps has a tapered width increasing toward the lower end.

4. A shapesuit according to claim 1, wherein the upper end of each of the stretchable straps is sewn to a portion of the body substantially corresponding to the armpit.

5. A shapesuit according to claim 1, wherein the lower end of each of the stretchable straps is sewn to the edge of a leg opening.

6. A shapesuit according to claim 1, wherein a stretchable buttock supporting strap is extended from the lower end of each of the stretchable straps extended in an X-shape on the back body along the edge of the leg opening toward the crotch and is sewn to the edge of the leg opening.

7. A shapesuit comprising:

a body formed by sewing together a front body and a back body;

a pair of stretchable straps extended diagonally and substantially in an X-shape along the front body and the middle portions thereof intersect each other so as to move freely with respect to each other;

another pair of stretchable straps extended diagonally and substantially in an X-shape on and sewn to the back body so that the middle portions thereof intersect each other, and wherein unstretchable side straps are extended longitudinally along the seams between the front body and the back body, wherein the opposite ends of the stretchable straps are sewn to the unstretchable side straps.

8. A shapesuit according to claim 7, wherein the front and the back body are formed of a material of stretchable fibers having an elasticity less than that of the stretchable straps.

9. A shapesuit according to claim 7, wherein each of the stretchable straps has a tapered width increasing toward the lower end.

10. A shapesuit according to claim 7, wherein the upper end of each of the stretchable straps is sewn to a portion of the body corresponding to the armpit.

11. A shapesuit according to claim 7, wherein the lower end of each of the stretchable straps is sewn to the edge of a leg opening.

12. A shapesuit according to claim 2, wherein a stretchable buttock supporting strap is extended from the lower end of each of the stretchable straps extended in an X-shape on the back body along the edge of the leg opening toward the crotch and is sewn to the edge of the leg opening.

13. A suit comprising:

a body having a front body and a back body coupled with each other;

a pair of unstretchable side straps extended longitudinally along the seams between the front body and the back body; and a pair of stretchable straps extended diagonally and substantially in an X-shape, and the ends of the stretchable straps connected to the unstretchable side straps wherein the middle portions of the stretchable straps move freely with respect to each other.

14. A shapesuit according to claim 13, wherein the front and the back body are formed of a material of stretchable fibers having an elasticity less than that of the stretchable straps.

15. A shapesuit according to claim 13, wherein each of the stretchable straps has a tapered width increasing toward the lower end.

16. A shapesuit according to claim 13, wherein stretchable buttock supporting strap is extended from the lower end of each of the stretchable straps extended in an X-shape on the back body along the along the edge of the leg opening toward the crotch and is sewn to the edge of the leg opening.

* * * * *